US005802882A

United States Patent [19]

Girard et al.

[11] Patent Number: 5,802,882

[45] Date of Patent: Sep. 8, 1998

[54] KNITTED COVER

[75] Inventors: William E. Girard, Ontario, Canada; Daniel J. Forest, Macomb, Mich.; Malcolm Frederick Proctor, Nottingham; Gerald Francis Day, Derbyshire, both of United Kingdom

[73] Assignee: General Motors Corporation, Detroit, Mich.

[21] Appl. No.: 657,214

[22] Filed: Jun. 3, 1996

[51] Int. Cl.[6] ..... D04B 1/16

[52] U.S. Cl. ..... 66/170; 66/202

[58] Field of Search ..... 66/202, 196, 197, 66/198, 170, 169 R, 190; 28/144, 156, 157, 158, 159, 160, 163, 167; 442/308, 310, 311

[56] References Cited

U.S. PATENT DOCUMENTS

| | | | |
|---|---|---|---|
| 3,357,075 | 12/1967 | Law | 28/156 |
| 3,691,796 | 9/1972 | Myer | 66/202 |
| 3,795,569 | 3/1974 | Piller et al. | 66/202 |
| 4,079,602 | 3/1978 | Blore | 66/196 |
| 4,750,339 | 6/1988 | Simpson, Jr. et al. | 66/202 |
| 5,213,863 | 5/1993 | Day et al. | 66/196 |
| 5,308,141 | 5/1994 | Robinson et al. | 297/218 |
| 5,326,150 | 7/1994 | Robinson et al. | 297/218 |
| 5,428,969 | 7/1995 | Day et al. | 66/202 |

FOREIGN PATENT DOCUMENTS

| | | |
|---|---|---|
| 0 627 516 A1 | 12/1994 | European Pat. Off. . |
| 1353066 | 5/1974 | United Kingdom . |
| 2193980 | 2/1988 | United Kingdom . |
| 2253217 | 9/1992 | United Kingdom . |
| 2253418 | 9/1992 | United Kingdom . |
| 2299592 | 10/1996 | United Kingdom . |

*Primary Examiner*—C. D. Crowder
*Assistant Examiner*—Larry D. Worrell, Jr.
*Attorney, Agent, or Firm*—George A. Grove

[57] ABSTRACT

Where a knitted cover is intended to be subjected to a heat treatment to stabilize or otherwise process the fabric, it is useful to form a knitted-in portion (in an unobtrusive portion of the cover) using a suitably heat-sensitive yarn so that such heat treatment indicator portion undergoes a visual and tactile change to reveal that the cover has been so treated.

15 Claims, 3 Drawing Sheets

KNITTED COVER

This invention relates to knitted covers and in particular to knitted covers which are subject to a heat treatment prior to use.

BACKGROUND OF THE INVENTION

Some knitted covers are subject to treatment prior to fitting to an object in order to stabilize the fabric and, in the case of a chenille-type yarn, to bond the pile to the core of the yarn. It is, therefore, a necessity to be able to differentiate between the covers which have been heat treated and those which have not prior to assembly of the cover to its respective object.

It is known to use thermochromic dyes in the yarns which then may change color on passing through a heat treatment oven at a predetermined minimum temperature. However, when the knitted cover is used in color critical end uses, for example, a three-dimensional knitted seat cover for use in automobiles, it is not possible to use ground yarns containing thermochromic dyes.

A small, integrally knitted flap or tab could be formed on a non-critical portion of the cover using a thermochromic yarn. However, this would have a disadvantage that an additional yarn would have to be provided to the knitting machine, and since 3D knitted covers tend to fold back on themselves, a purely visual indicator in a non-critical portion may be difficult to locate on a seat manufacturing production line. Furthermore, the change in color may not always by obvious to a non-skilled person and may not be appreciated by an assembly line operator.

SUMMARY OF THE INVENTION

The present invention provides a heat treatment indicator that is both visual and tactile. Accordingly, there is provided a knitted cover having a visual and tactile indicator portion formed thereon during the knitting process to indicate when said cover has passed through a heat treatment, said indicator portion being knitted integrally with the cover and being capable of changing its physical form after heat treatment.

Because the indicator portion changes in physical form, it has both a visual impact and can be detected by feel. The cover is knitted from at least one ground yarn and the indicator portion is knitted at least in part from a heat sensitive yarn.

A heat sensitive yarn can be a heat shrink yarn, a low temperature melt yarn, a heat fusible yarn, or a yarn that vaporizes or sublimates on the application of heat, or a combination of such yarns. Preferably, the heat sensitive yarn should be sensitive to exposure to a temperature in the range of 90° C. to 150° C. Typically, the heat sensitive yarn will be a combination of a high shrink yarn and a low temperature melt yarn such as Shima X™ yarn available from the Shima Seiki Manufacturing Co. of Japan.

While the method is applicable to both single jersey and double jersey construction, the cover is preferably a double jersey weft knitted cover of the type used for automobile seats and disclosed in U.S. Pat. Nos. 5,308,141 and 5,326,150.

Also according to the invention, there is provided a method of providing a heat treatment indicator on a knitted cover to indicate when the cover has passed through a heat treatment process, wherein an indicator portion is knitted integrally with the cover at least in part from a heat sensitive yarn, and after heat treatment the indicator portion changes its physical form.

Preferably a double jersey weft knitted cover is knitted from at least one ground yarn on a weft knitting machine having needles arranged in two independently operable needle beds with the fabric having a front layer knitted on one needle bed and a rear layer knitted on the other bed, where the indicator portion is knitted from a heat sensitive yarn for a at least one course on at least one needle bed.

According to yet another aspect of the invention, there is provided a method of indicating if a knitted cover has passed through a heat treatment at a given temperature by knitting a heat sensitive yarn into an indicator portion thereof so that said portion changes its physical form on passing through the heat treatment.

Preferably the knitted double jersey fabric has its front layer formed from a chenille yarn and its back layer formed from a non-chenille polyester yarn. The chenille yarn may be of the type disclosed in published European application EP-A-627,516. The chenille yarn may have a decitex in the range of 1500 to 3000. Conveniently the fabric has 8 to 16 wales per inch (2.54 cm) in a course-wise direction, and in the range 8 to 30 courses per inch in the wale-wise direction, the chenille yarn being knitted into the fabric as knitted looped stitches.

The polyester yarn is preferably an air-textured polyester yarn having a decitex in the region 550 to 900, or 600 to 800, or 600 to 750, or 650 to 700 decitex. The chenille yarn may be formed of a pair of twisted nylon and/or polyester strands, for example, and may contain one or more low-melting point nylon strands which must be heat treated, or the pile may be moveable relative to the strands.

The chenille yarn may have a count in the range of 1500 to 3000 decitex. The chenille yarn is preferably one having moveable pile and/or an extensible core.

Preferably, the air textured polyester yarns are continuous filaments yarns having a count, in the unrelaxed state, of 680 to 750 decitex.

Preferably, the method of knitting is such that, in the relaxed state, the fabric has from 4 to 6 wales per cm.

The fabric may be knitted on a flat bed knitting machine having a pair of opposed needle beds. The machine may have a gauge in the range 10 to 16, preferably 10 to 14, further preferably 12.

The machine may be a double system machine or a triple system or four system machine.

The present invention provides a method of knitting a cover, preferably an upholstery fabric, in which the knitting is carried out on a machine having a pair of opposed independently operable needle beds and in which the needles in each bed can be moved independently of one another in that bed into the path of an operating cam box reciprocating along the needle beds.

An upholstery fabric for a vehicle seat preferably has a weight in the relaxed state ready for use in excess of 500 $g/m^2$, preferably 500 to 900 $g/m^2$. This compares to traditional knitted products which have a weight of 300 to 350 $g/m^2$.

Preferably, the upholstery fabric is a weft knitted upholstery fabric formed of yarn having a decitex in the range 625 to 850 and having been knitted on a machine having a machine gauge in the range 10 to 18, the fabric being of generally double jersey construction.

BRIEF DESCRIPTION OF THE DRAWINGS

The invention will be described by way of example and with reference to the accompanying drawings in which.

DESCRIPTION OF PREFERRED EMBODIMENTS

Figure 1:
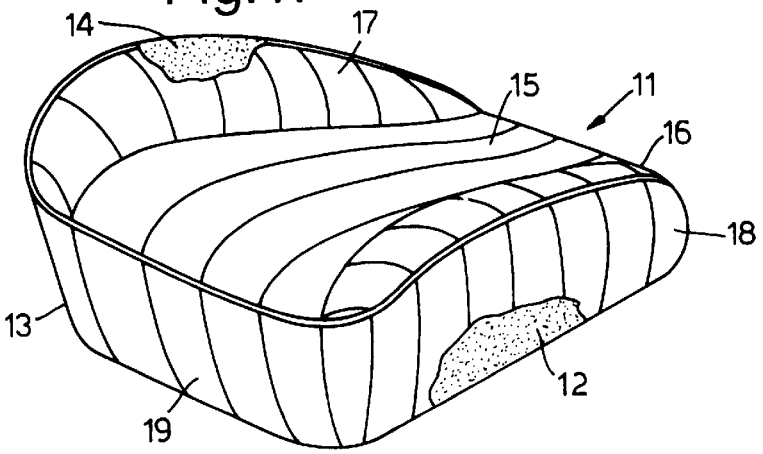
FIG. 1 is a perspective view of a seat base.

Referring to FIG. 1, there is shown a seat base 11 for a seat. The seat base 11 incorporates a three dimensional foam core structure 12 over which a fabric cover 13 is stretched. The form core structure may be of any desired shape and, as shown in the present example, has wings 14. The fabric cover 13 is a three dimensional knitted cover incorporating side wings 16,17, a base and integrally knitted edge members 18 and 19 which are secured to the base of the seat in a known manner. Such seat bases are typically used in automobiles.

In order that the invention can be fully understood, reference will be made to a flat V-bed knitting machine. More details on such knitting machines are to be found in the publication "Dubied Knitting Manual" published by Edouard Dubied et Cie SA, Neu Chatel, Switzerland in 1967. Flat V-bed knitting machines are very well known and many such machines are now computer controlled. It has been proposed recently to manufacture upholstery fabric on such flat V-bed knitting machines and proposals have been made (see, for example, U.S. Pat. No. 5,308,141 and U.S. Pat. No. 5,326,150) to knit upholstery fabric suitable for use in vehicles.

The knitting of a fabric by the method according to the invention uses a Stoll CMS machine with 12 gauge needles. This machine is a flat V-bed machine of the type provided with a loop hold-down device, such as a presser foot or sinker, to assist take-down of the knitted fabric. The machine can operate with a plurality of yarns supplied, each of which is associated with a respective cam box. The cam box transverses across the needle beds supplying yarn to the needles as desired in each direction of travel.

The fabric cover 13 is a double jersey weft knitted structure. Essentially, such a double jersey structure comprises a pair of single jersey fabric layers formed of interconnected loops or stitches of yarn wherein the opposing pairs of layers are interconnected by further loops of yarn. It is possible to produce highly complex designs on the fabric structure by automatically controlling the operation of the knitting needles and particularly where two or three colors of yarn are used. Normally such fabrics would be knitted with a jacquard knitting machine in which the colors of the face of the fabric can be determined by suitable needle selection.

Conveniently, it is only the technical face of the fabric which has to have the attractive appearance. The technical reverse of the fabric, either being covered with a reinforcing or padding layer or being directly in contact with the core 12 of the upholstered product, is of no particular interest to the eventual consumer.

Figure 2:
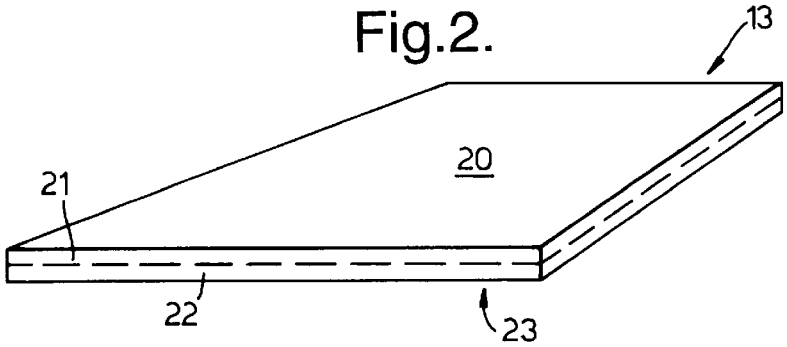
FIG. 2 is a schematic view of a piece of double jersey fabric.

The fabric cover is a double jersey weft knitted structure. Illustrated in FIG. 2 is a schematic view of a portion of a double jersey fabric cover 13. The cover 13 has a technical face 20 effectively comprising a series of loops in a front layer 21 of fabric formed on one needle bed of a knitting machine and a technical reverse, or rear, face 23 formed on series of loops in a rear layer 22 of fabric formed on the second needle bed of the knitting machine.

Figure 3:
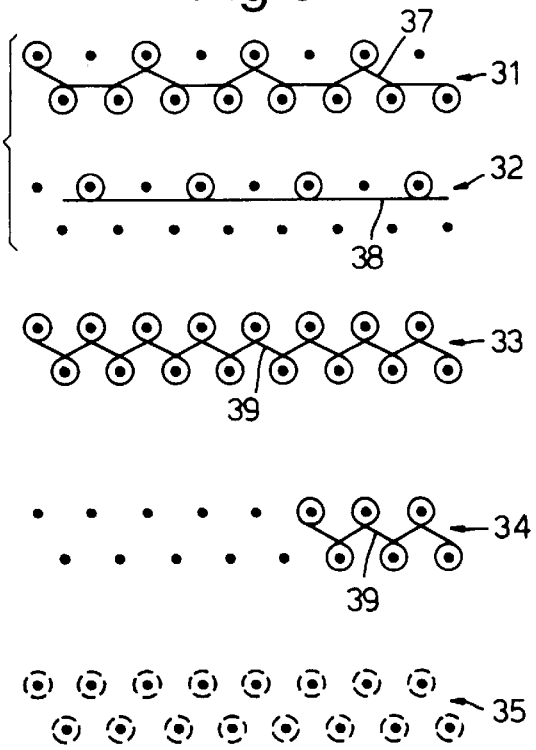
FIG. 3 is a knitting diagram of a first embodiment of the present invention.

Referring to FIG. 3, there is shown a stitch diagram in which each row 31–35 represents a row of knitting on one pass of the yarn carrier. In each row, the upper line of small dots represents individual needles on the rear needle bed of a knitting machine, and the lower row of dots represents the needles of the front needle bed of the knitting machine. In the terminology used herein, the front layer 21 of the fabric 13 is knitted on the front needle bed and the rear layer 22 of fabric is knitted on the rear needle bed. The yarn is represented by loops and interconnecting cross-links.

It will be appreciated that the stitch diagram represents only a small portion of the cover as is required for illustrating the invention.

Figure 4:
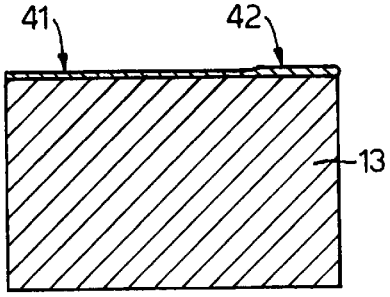
FIG. 4 is a portion of knitted material according to the first embodiment of the invention.

Referring to FIGS. 3 and 4, the cover 13 is knitted from at least one ground yarn knitted into a plurality of courses having any desired knitted construction, in this case a double jersey weft knitted construction having a bird's eye structure as shown in knitted rows 31 and 32, which make up a repeat unit R1 of the knitted structure. The yarns 37, 38 used in the rows 31 and 32 respectively may be the same yarn or different colored yarns, or different material yarns such as polyester yarns and chenille yarns.

At the end of the normal knitting, at least one row 33, and preferably two or four rows, of fusible yarn 39 is knitted on all the needles as is normal prior to pressing off to form a fusible finish 41 on the fabric. The fusible yarn is then knitted on a smaller number of selected needles for between a further four and ten rows, represented by row 34. All the needles are then pressed-off as is shown in row 35.

The plurality of rows 34 form a small flap 42 or tab which serves as a heat treatment indicator.

After heat treatment in dry heat at 150° C. for six minutes, the indicator flap 42 forms a bulkier and slightly harder section to the pressed-off edge of the fabric cover 13. The heat treatment indicator 42 is located in an area of low visual criticality, such as underneath the seat base.

Figure 5:
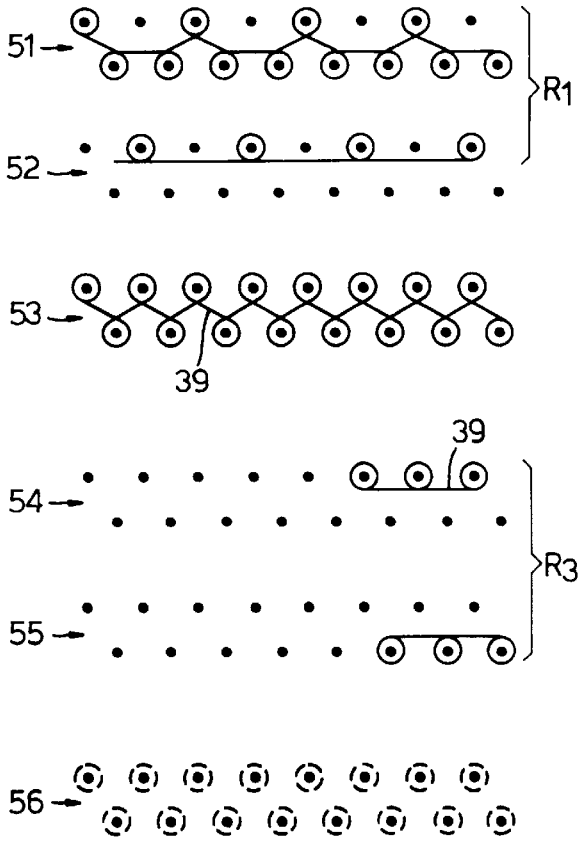
FIG. 5 is a knitting diagram of a second embodiment of the present invention.
Figure 6:
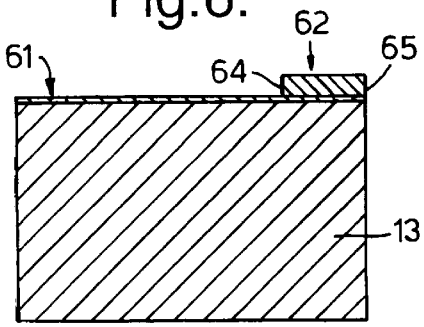
FIG. 6 is a portion of knitted material according to the second embodiment of the invention.

Referring to FIGS. 5 and 6, there is disclosed an alternative form of heat indicator 62. As previously described with reference to FIG. 3, the cover 13 comprises knitted rows 51 and 52 of ground yarn 37, 38 which make up the repeat unit R1 of a bird's eye structure knitted fabric, and the knitting is finished with at least one row 53 of a fusible yarn 39 forming a fusible finish 61. The fusible yarn 39 is then knitted on the rear bed of needles only in row 54, and a polyester ground yarn 37 or 38 is knitted on the front needle bed only as is shown in row 55.

The rows 54, 55 make up a repeat unit R3, which is repeated for between four and 10 courses to form a tube comprising two single jersey layers. When the yarn carrier for the rear needle bed is mounted over the front needle bed and vice versa, the selvedges 64, 65 of the indicator 62 are closed, forming a pocket. Thereafter, the yarn is pressed-off as per row 56.

After heat treatment, the indicator 62 tends to buckle toward the rear face of the knitted fabric.

Figure 7:
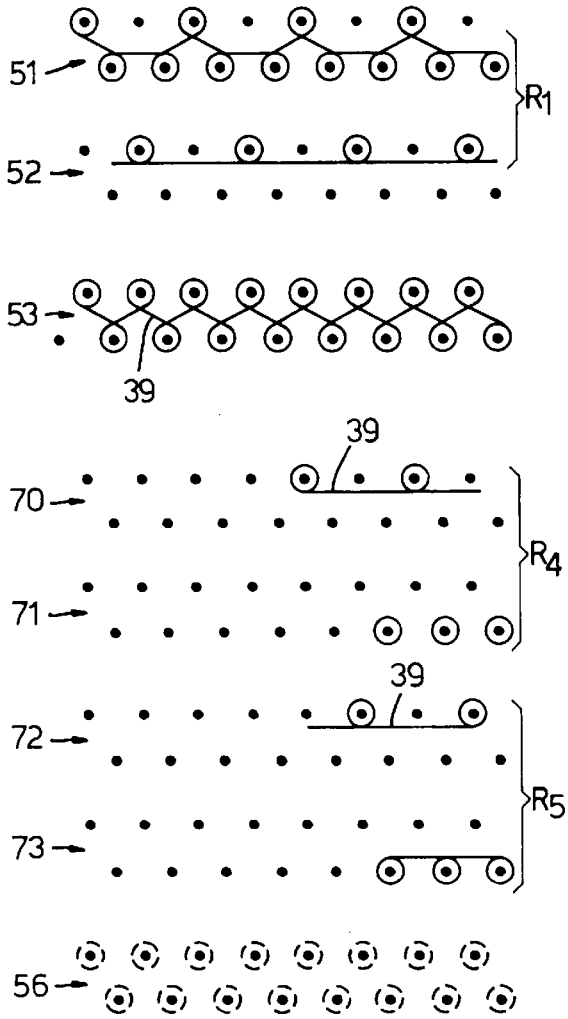
FIG. 7 is a knitting diagram of a modified form of the second embodiment.

Referring to FIG. 7, there is shown a similar type of heat sensitive indicator 72 to that shown in FIG. 5, except that after knitting the fusible finish 61 in row 53, the fusible yarn 39 is knitted on alternate needles on the rear needle bed as shown in rows 70–73 and repeat units R4 and R5. This construction provides less fabric material in the rear layer so that after heat treatment, the fabric in the rear layer will shrink more than that shown in FIG. 5 to give an even more pronounced buckling of the heat treatment indicator 72.

Figure 8:
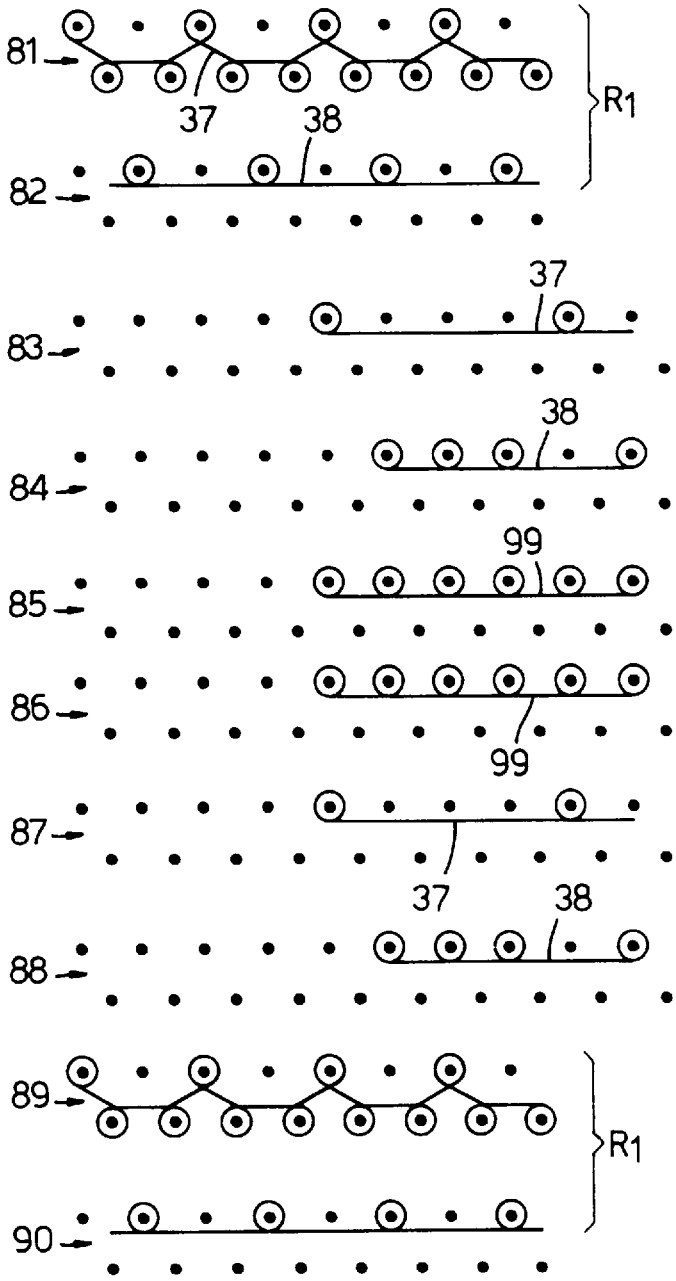
FIG. 8 is a knitting diagram according to yet another embodiment of the invention.
Figure 9:
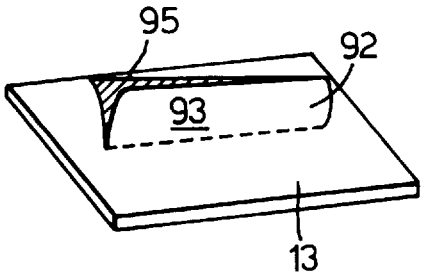
FIG. 9 is a portion of knitted material according to the embodiment shown in FIG. 8.

Referring to FIGS. 8 and 9, there is disclosed a further embodiment of the invention in which the cover 13 is knitted in a general bird's eye construction as shown in rows 81 and 82 of a ground yarn 37,38 as previously described. At a predetermined course, the front needles are held up while knitting continues on selected needles on the rear needle bed to form a flap 92. The formation of the flap is shown in rows 83–88.

The first ground yarn 37, preferably a polyester yarn, is preferably knitted on every fourth needle in row 83, and the second ground yarn 38 is preferably knitted on the other three needles in row 84. Rows 83 and 84 form a single course for one pass of the cam box, and the first side 93 of the flap 92 will comprise between four to ten courses.

When the first side of the flap has been completed, a heat vaporizable yarn 99 is knitted on all selected needles for at least two rows 85 and 86.

The second side 95 of the flap 92 is then knitted in the same manner as the first side 93 as shown in rows 87 and 88. After completion of the second side of the flap, knitting recommences on both needle beds as shown in rows 89 and 90 to form the rest of the cover.

When the fabric is heat treated, the heat vaporizable yarn disintegrates, allowing the flap to open into two halves and curl back on itself. Because of the knitting of the two ground yarns 37 and 38, if these are of different colors, the inside of the flap is a different color shade to the outside of the flap so that the heat indicator 92 not only changes physical form but also exhibits a distinct color helping to draw the attention of an operator.

This indicator has the further advantage that it can be formed anywhere on the rear layer of the double jersey fabric and is not confined to the press-off edge of the fabric.

While this invention has been described in terms of certain preferred embodiments thereof, it will be appreciated that other forms could readily be adapted by one skilled in the art. Accordingly, the scope of this invention is to be considered limited only by the following claims.

What is claimed is:

1. A double jersey weft knitted cover having a front layer and a rear layer, said cover being knitted from at least one heat-treatable ground yarn and having a visual and tactile indicator portion formed thereon during knitting to indicate whether said cover has passed through a heat treatment, said indicator portion comprising a flap knitted integrally with the cover and comprising two layers of knitted fabric, at least one layer being knitted from heat-sensitive yarn and being capable of changing its physical form after heat treatment.

2. A double jersey weft knitted cover as recited in claim 1 in which said flap comprises a front knitted layer knitted in the front layer of said cover and a rear layer.

3. A double jersey weft knitted cover as recited in claim 1 in which said flap comprises a front knitted layer knitted in the rear layer of said cover and a rear layer.

4. A double jersey weft knitted cover as recited in claim 2 wherein the front layer of the indicator flap comprises ground yarn and the rear layer of the flap comprises heat-sensitive yarn.

5. A double jersey weft knitted cover as recited in claim 3 wherein the front layer of the indicator flap comprises ground yarn and the rear layer of the flap comprises heat-sensitive yarn.

6. A double jersey weft knitted cover as recited in claim 4 wherein the heat-sensitive yarn forms knitted loops in alternate wales in its respective layer.

7. A double jersey weft knitted cover as recited in claim 5 wherein the heat-sensitive yarn forms knitted loops in alternate wales in its respective layer.

8. A double jersey weft knitted cover as recited in claim 1 wherein said indicator flap comprises two layers of single jersey knitted integrally with the double jersey fabric, at least one single jersey layer being formed of heat-sensitive yarn.

9. A double jersey weft knitted automobile seat cover having a front layer and a rear layer and which is knitted from at least one heat-treatable ground yarn and has a visual and tactile indicator portion formed thereon during knitting to indicate whether said cover has passed through a heat treatment, said indicator portion comprising a flap knitted integrally with the cover and comprising two layers of knitted fabric, at least one layer being knitted from heat-sensitive yarn and being capable of changing its physical form after heat treatment.

10. A method of providing a heat treatment indicator for a double jersey weft knitted cover knitted from at least one heat-treatable ground yarn on a weft knitting machine having needles arranged in two independently-operable needle beds, said method comprising knitting a front layer of said cover on one needle bed, knitting a rear layer of said cover on the other needle bed, and knitting an indicator flap comprising two layers of fabric on at least one needle bed to form at least one layer of the flap from a heat-sensitive yarn so that the indicator flap changes its physical form after the heat treatment.

11. A method as recited in claim 10 comprising knitting the indicator flap from the heat-sensitive yarn on both needle beds for at least one course.

12. A method as recited in claim 10 comprising forming the indicator flap by knitting a heat-sensitive yarn on one needle bed and a ground yarn on the other needle bed for a plurality of courses.

13. A method as recited in claim 10 comprising knitting the indicator flap on the rear layer of said double jersey weft knitted cover.

14. A method as recited in claim 10 comprising knitting the indicator flap adjacent a finishing course of said knitted cover.

15. A double jersey weft knitted automobile seat cover as recited in claim 9 wherein said indicator portion is formed on a portion of the cover that is not easily visible after fitting of the cover to a seat.

* * * * *